US005588179A

United States Patent [19]

Bargiel et al.

[11] Patent Number: 5,588,179

[45] Date of Patent: Dec. 31, 1996

[54] DUST BOX EMPTYING DEVICE

[75] Inventors: Douglas A. Bargiel, Bowling Green; Jack L. Burgoon, Toledo; Michael D. Combs, Bowling Green, all of Ohio

[73] Assignee: Clarke Industries, Inc., Bowling Green, Ohio

[21] Appl. No.: 381,726

[22] Filed: Feb. 1, 1995

[51] Int. Cl.[6] ..... E01H 1/08

[52] U.S. Cl. ..... 15/349; 15/352; 55/432

[58] Field of Search ..... 15/347, 348, 349; 55/432

[56] References Cited

U.S. PATENT DOCUMENTS

| | | | |
|---|---|---|---|
| 3,304,572 | 2/1967 | Wendel | 15/340 |
| 3,604,051 | 9/1971 | Wendel et al. | 15/340 |
| 3,639,940 | 2/1972 | Carlson et al. | 15/349 X |
| 4,194,262 | 3/1980 | Finley et al. | 55/432 X |
| 4,224,043 | 9/1980 | Dupre | 55/432 X |
| 4,574,420 | 3/1986 | Dupre | 55/432 X |
| 5,226,757 | 7/1993 | Tarrant | 406/39 |
| 5,254,146 | 10/1993 | Beaufoy | 55/320 |
| 5,303,448 | 4/1994 | Hennesey et al. | 15/349 X |

*Primary Examiner*—Chris K. Moore

*Attorney, Agent, or Firm*—Senniger, Powers, Leavitt & Roedel

[57] ABSTRACT

A flap of an elastomeric material is disposed over an outlet opening in a dust box within a main hopper of an industrial-type sweeper, the outlet opening providing communication between the dust box and the main hopper for emptying of the contents accumulated within the dust box. The flap is positioned over the outlet opening and is operative to provide selective communication between the dust box and the main hopper. During dirt and debris collection, such is accumulated within the dust box, while during emptying the dirt and debris are allowed to fall into the main hopper for egress through the hopper inlet. In one embodiment, the main hopper door controls the selective communication of a slotted flap through connection of one end of the flap to the hopper door. In another embodiment, air pressure regulates the opening and closing of the flap.

15 Claims, 4 Drawing Sheets

DUST BOX EMPTYING DEVICE

FIELD OF THE INVENTION

The present invention relates to industrial type sweepers and, more particularly, is directed towards an improved device for emptying the contents of a dust box within the debris hopper of a sweeper.

BACKGROUND OF THE INVENTION

Industrial sweepers of the type having a hopper for the accumulation of dust and debris are well known in the art. A rotating brush sweeps the dust and debris on the floor into the hopper through a hopper inlet located adjacent the brush. An air suction system is also employed to assist in the dust and debris collection by creating a suction air path from the hopper inlet, into the hopper, and through a filter element. The filter element is disposed within the hopper generally proximate the air suction system source.

In on-going efforts to provide more efficient collection of dust and debris, the design of the hopper has evolved from a single open chamber hopper into a multiple-chamber hopper. The multiple-chamber hopper generally consists of a conventional-type hopper subdivided by internal walls or partitions into a main hopper and what is termed a dust box. The dust box may be further subdivided by a wall or partition to thereby define a dirty side and a clean side to the dust box. A filter is generally disposed between the dirty side and the clean side of the dust box, wherein the terms are defined.

The main hopper is designed to accumulate large debris and particles while the dust box is designed to accumulate small debris, dust and particulate matter. This is generally accomplished by creating a tortuous air flow pattern within the hopper. This creates a separating effect for the debris, but only allows the inflow of such debris. Once the main hopper and dust box is full of dust and debris, it must be emptied. This is generally accomplished by raising the hopper up and away from the body of the sweeper through a pivot and hydraulic system. The debris exits from the hopper through the hopper inlet opening when the hopper door is opened upon the hopper reaching the apex of its travel.

In order for the debris and fine particulates to be emptied from the dust box, an outlet opening is disposed in the bottom partition partly defining the dust box. The outlet opening of the dust box is generally remote from the inlet opening to the dust box and is at the lowest point of the dust box in order for the particulate matter to settle over or adjacent the outlet opening.

These prior art hoppers, incorporating separate dust boxes, generally have complicated mechanics and/or hydraulics to maintain the outlet opening of the dust box closed when the sweeper is accumulating debris, and which opens the outlet opening of the dust box during the dumping operation to allow the accumulated debris to fall into the main hopper. From there, the dirt and debris exits the hopper inlet/outlet. Such complicated machinery, installed within a very dirty environment, is subject to complications.

It is therefore an object of the present invention to provide a non-mechanical dust box dumping mechanism.

SUMMARY OF THE INVENTION

The present invention provides a selective opening and closing of an outlet opening in a dust box of a dumpable hopper type sweeper. The outlet opening provides an exit for the particulate matter accumulated within the dust box.

A flap of an elastomeric material is positioned over the outlet opening and is operative to provide selective communication between the dust box and the main hopper. During dirt and debris collection, such is accumulated within the dust box, while during emptying the dirt and debris are allowed to fall into the main hopper for egress through the hopper inlet.

In one embodiment, the main hopper door controls the selective communication of a slotted flap through connection of one end of the flap to the hopper door.

In another embodiment, air pressure developed by the sweeper suction system, controls the opening and closing of the flap.

BRIEF DESCRIPTION OF THE DRAWINGS

So that the manner in which the above-recited features, advantages, and objects of the present invention are attained and can be understood in detail, a more particular description of the invention, briefly summarized above, may be had by reference to the embodiments thereof which are illustrated in the appended drawings.

It is noted, however, that the appended drawings illustrate only a typical embodiment of this invention and is therefore not to be considered limiting of its scope, for the invention may admit to other equally effective embodiments. Reference the appended drawings, wherein.

DETAILED DESCRIPTION

Figure 1:
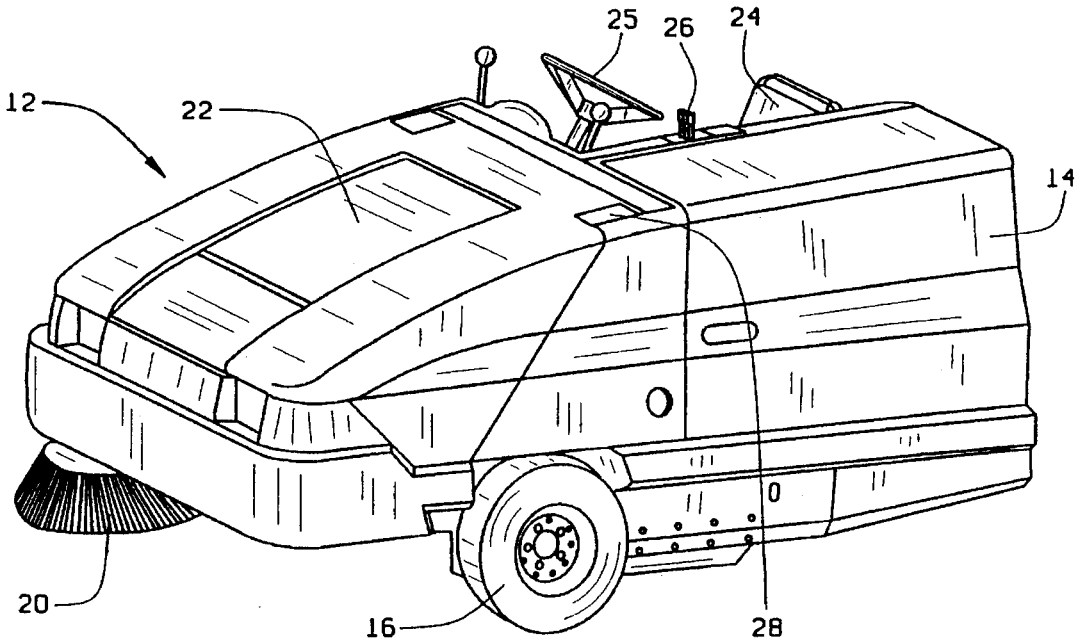
FIG. 1 is an elevational view of a typical industrial riding sweeper of the type having a dumpable debris hopper.

Referring now to FIG. 1, there is shown an industrial type riding sweeper generally designated 12. The sweeper 12 includes a body or frame 14 carried by a pair of front wheels of which only one front wheel 16 is shown. Additionally, and in reference to FIG. 2, a single rear wheel 18 also movably supports the body 14. Located at the front of the sweeper 12 is a circular sweeping brush 20 that helps sweep the encountered dirt and debris into the sweeper. Located at one side of the sweeper 12 is a seat 24 for the operator as well as a steering wheel 25 and various controls 26 for the sweeper 12.

Figure 2:
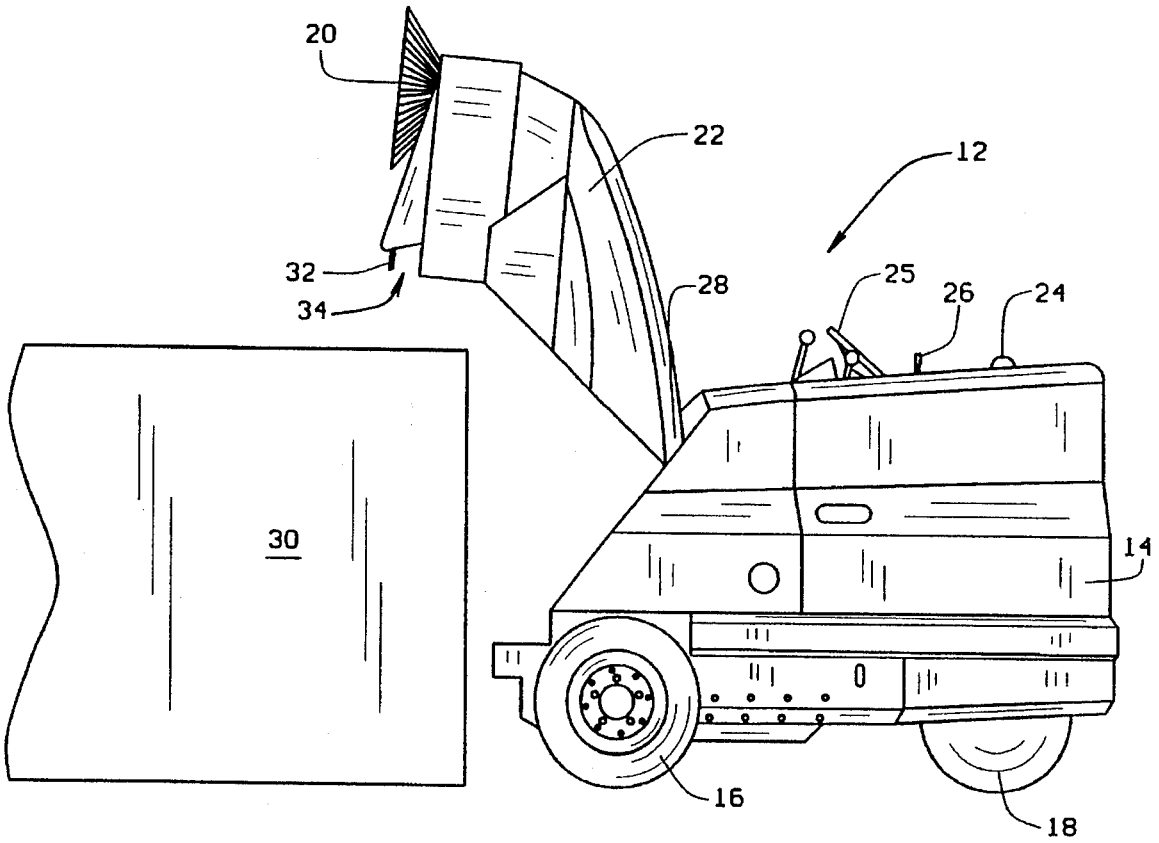
FIG. 2 is an elevational view of the sweeper of FIG. 1 depicting the final dumping position of the hopper.

As best seen in FIG. 2, the sweeper 12 includes a main hopper 22 that is pivotably connected to the main sweeper body 14 at 28. Although not shown, various hydraulics are utilized to raise the hopper 22 from its sweeping position as depicted in FIG. 1 to its dumping position as depicted in FIG. 2.

FIG. 2 depicts the sweeper 12 emptying the contents of the hopper 22 into a bin 30. In this position, and as discussed hereinbelow, the accumulated debris will exit through the hopper inlet/outlet opening 34 when the hopper door 32 is opened.

Figure 3:
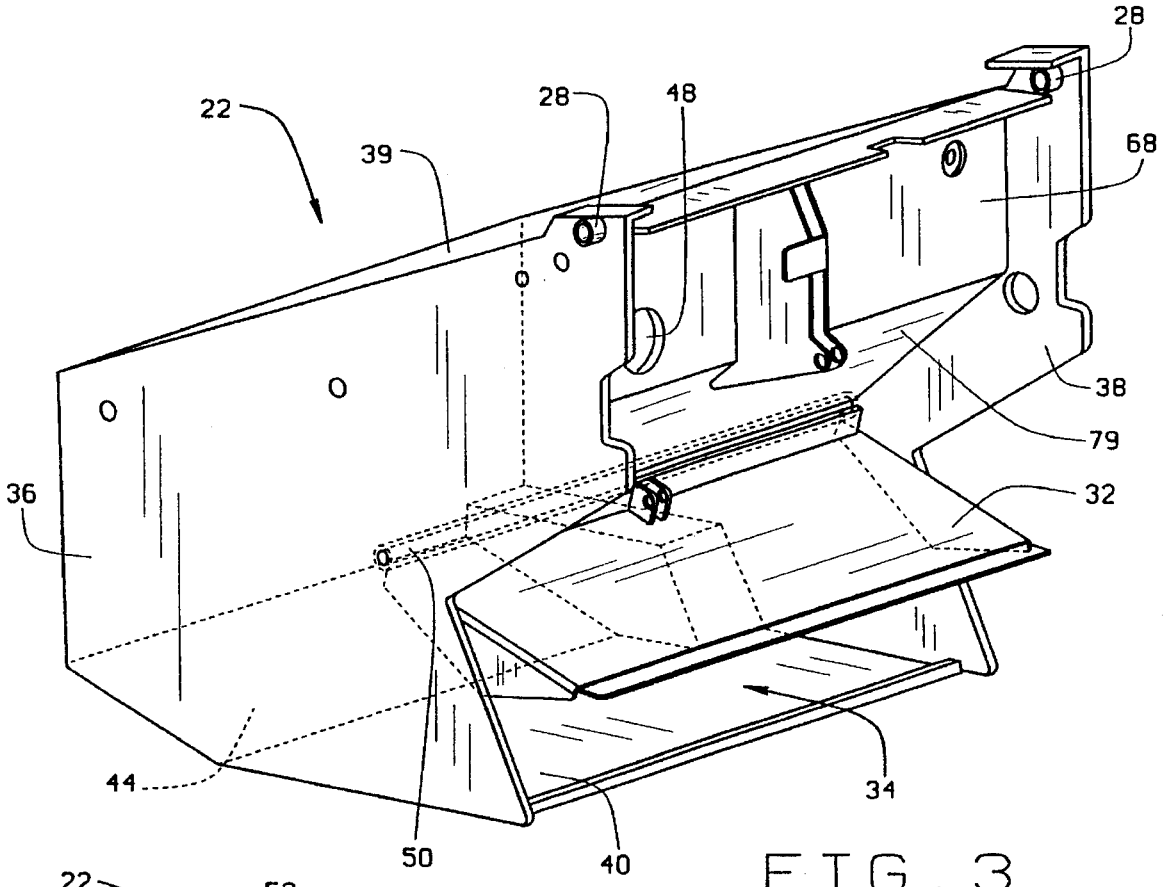
FIG. 3 is an enlarged perspective view of the hopper of the sweeper of FIGS. 1 and 2 showing the hopper inlet door in the open or debris collection position.

Referring now to FIG. 3, there is shown the main hopper 22 enlarged and separate from the sweeper 12. The main hopper 22 is defined by a first sidewall 36, a second sidewall 38, a top wall 39, a bottom wall 49, and an end or rear wall 42 that defines an interior chamber 44 generally known as the main hopper. Defined between end walls 36 and 38 is an inlet opening/outlet. The hopper door 32 is hingedly connected at 50 and movable via hydraulics (not shown) or other means to open and close the hopper 22. The main hopper includes a bulkhead 68 that has an access opening 48 wherein suction is provided communicating with the interior 44 for assistance in the collection of the dust and debris within the interior chamber 44.

The bulkhead 68 includes a slanted wall 79 that projects inwardly to the hinge 50 and terminates with a seal 82. The bulkhead 68 and slanted wall 79 along with the sweeper frame defines a clean air chamber 71 that is open to the ambient air (see FIGS. 8–10).

Figure 8:
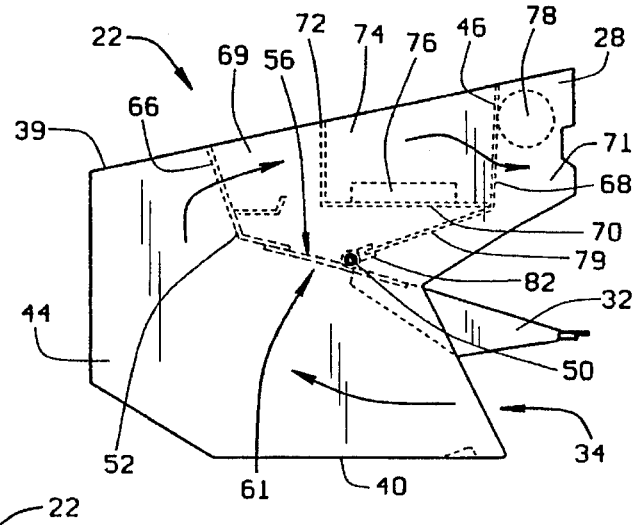
FIG. 8 is a side view of the hopper in the debris collection position wherein the hopper door is open, and the resilient dust box flap is in the closed position allowing the accumulation of debris within the dust box.

As best depicted in FIG. 8, the hopper 22 includes an interior front dust box wall 66, generally vertically disposed with relation to the top wall 39. An angled wall 52 extends from the front wall 66 and along with the hopper door 32 defines an outlet opening 61 being disposed between the hinge 50 and the angled wall 52. Thus, the walls 66 and 52 along with the hopper door 32 defines the hopper interior chamber 44, while the walls 52 and 66 along with the interior walls 68, 70, and 72 define the dust box 69. Walls 68, 70, 72, and bulkheads 68, 79 define a clean side 74 of the dust box 69 wherein a filter 76 is disposed over an opening (not shown) in the lower wall 70.

A suction device 78, such as a pump or the like, is disposed in clean side chamber 71 and communicates with opening 48 in bulkhead 68 to provide suction to the dust box interior 69 and interior chamber 44 of the hopper 22. In this regard, the arrows in FIG. 8 show the flow of dirt and debris due in part to the action of a rotating sweeper brush (not shown) and suction within the hopper 22 as provided by the suction device 78. The dirt and debris enters the hopper 22 via opening 34 through an opening (not shown) in wall 66, through the filter 76 and out the opening 48 in bulkhead 68. The larger pieces of debris and trash are deposited in the main hopper 44 while the smaller particulates flow into the dust box area 69. In accordance with the present invention, and described hereinbelow, the particulate material accumulated within the dust box 69 must eventually be emptied.

Figure 4:
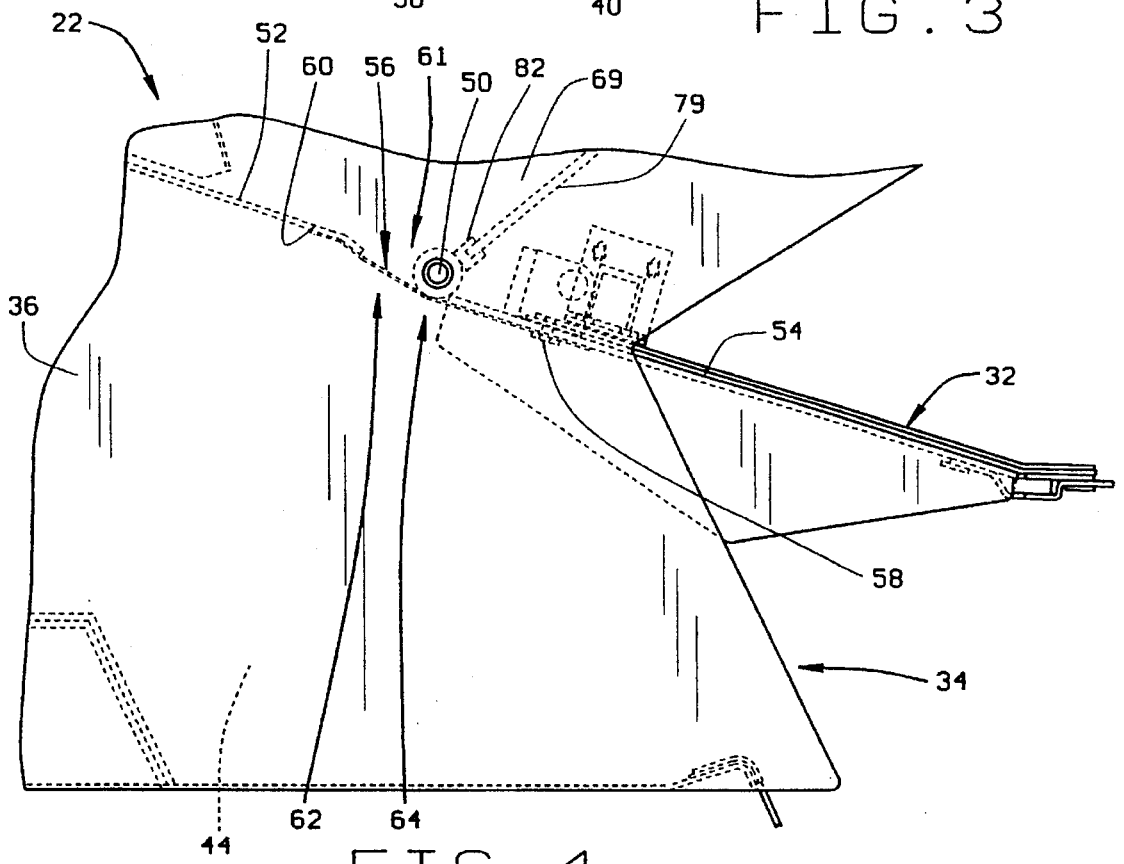
FIG. 4 is an enlarged fragmentary side view of the hopper of FIG. 3 showing the hopper inlet door in the open or debris collection position.
Figure 6:
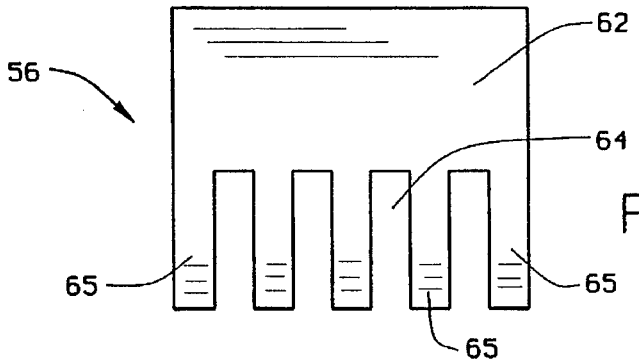
FIG. 6 is an enlarged top view of one embodiment of the resilient dust box flap.
Figure 7:
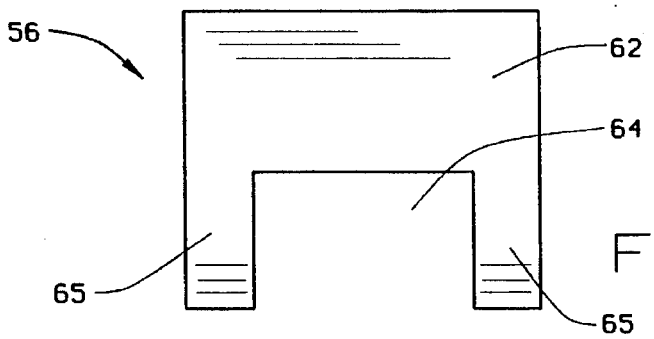
FIG. 7 is an enlarged top view of another embodiment of the resilient dust box flap.

Referring now to FIG. 4, attention is drawn to the juncture between wall 52 and pivot point 50. As described hereinabove, an outlet opening 61 is formed between the juncture of the wall 52, slanted wall 79, and the pivot point 50 along with a top plate 54 of the hopper door 32. As described hereinbelow with reference to operation of the present invention, the outlet opening 61 is covered by a flap 56 of a resilient type material. One embodiment of such a flap 56 is depicted in FIG. 6. In this particular embodiment, the flap 56 includes an upper solid portion 62 and a plurality of open slots 64 that define elongated fingers 65 of material. An alternative embodiment of the flap 56 is depicted in FIG. 7. In this embodiment, the flap 56 includes a solid top portion 62 and a single opening or cut out 64 that defines outside fingers 65. It should be understood that other slot or opening configurations may be utilized and are contemplated within the scope of the present invention.

As best seen in FIG. 4, the solid portion 62 of flap 56 is attached to the wall 52 along point 60. Each end 65 of flap 56 is attached to the hopper door 32 plate 54 at points 58 such that the flap 56 is stretched over the opening 61. When the hopper door 32 is in the open position as depicted in FIG. 4, which corresponds to either the debris collection position or the final emptying position, the flap 56 is taut over the opening 61 with the solid portion 62 extending from the end of wall 52 to the pivot 50. The opening(s) 64 of the flap 56 are forward of the opening 61 such that the opening 61 is effectively closed by the solid portion 62.

Figure 5:
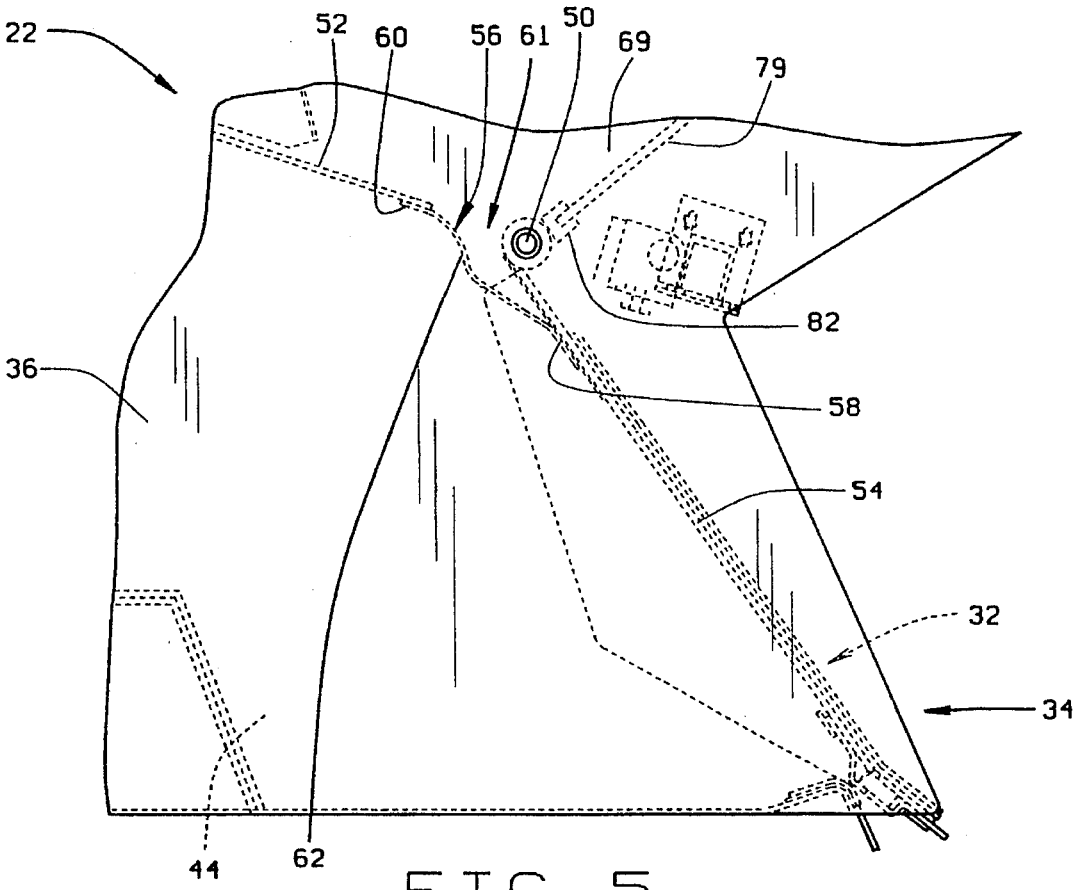
FIG. 5 is an enlarged fragmentary side view of the hopper of FIG. 3 showing the hopper inlet door in the closed or initial emptying position.

Referring now to FIG. 5, the hopper 22 is shown in the initial dumping state or position. The hopper door 32 has moved downwardly thereby closing opening 34. The movement of the plate 54 of the hopper door 32 relaxes the resilient flap 56 such that the flap 56 essentially bends allowing the opening(s) 64 to be in communication with the opening 61. In this manner, the dirt and debris within the dust box 69 falls by gravity through the opening 61 and opening(s) 64 into the main hopper area 44 holding the larger debris. At this point, it should be noted that the emptying state is accompanied by the temporary stopping of the suction device 78. In this manner, the movement of the hopper door controls the resilient flap 56 to provide selective communication of the dust box 69 with the main hopper portion 44 via opening 61.

OPERATION

Figure 9:
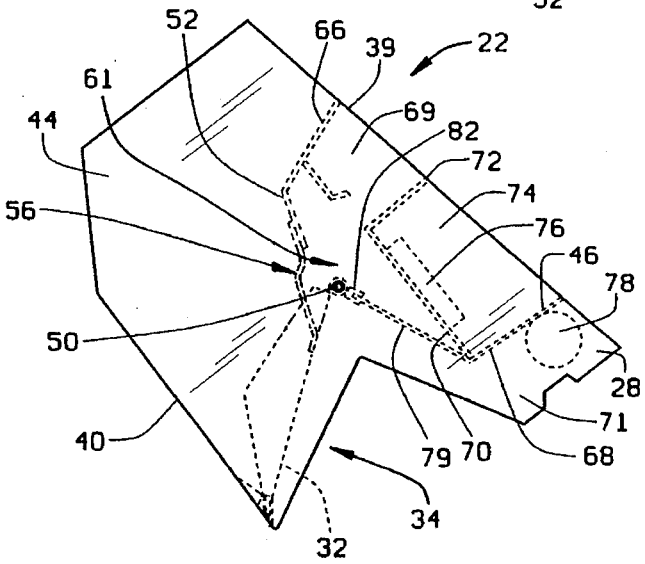
FIG. 9 is a side view of the hopper in the initial emptying position wherein the hopper door is closed, and the resilient dust box flap is in the open position allowing the emptying of the debris accumulated within the dust box.
Figure 10:
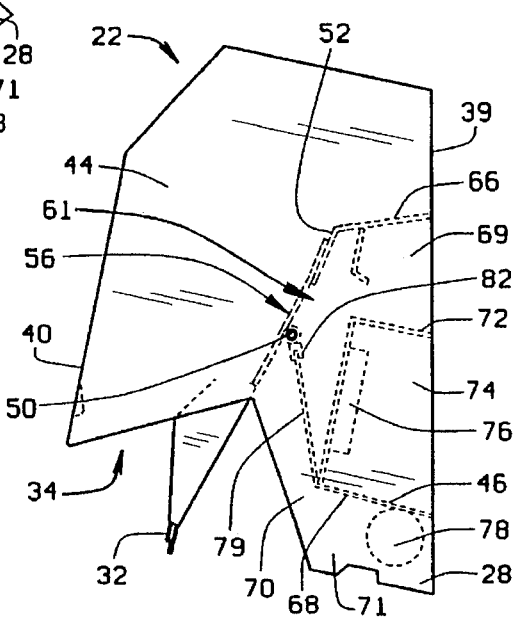
FIG. 10 is a side view of the hopper in the final emptying position wherein the hopper door is again open, and the resilient dust box flap is again closed allowing the emptying of the debris accumulated within the hopper and dust box.

In accordance with the present invention, and referring specifically to FIGS. 8–10, the dumping procedure is described. It should be understood that the hopper 22 depicted in FIGS. 8–10 is illustrational in that the exact configuration of the interior of the hopper 22 may not conform exactly to production models. However, the principle of the present invention is more easily understood with the aid of the hopper 22 depicted in the figures.

FIG. 8 depicts the normal debris collection position of hopper 22 wherein the hopper door 32 is open allowing opening 34 to be in communication with the broom chamber. Although not depicted in the figures, an elongated rotating brush is disposed proximate the opening 34 to drive the encountered debris into the main hopper 44. At this point, the resilient flap 56 is taut over opening 61 thereby closing off opening 61. The suction created by the suction device 78 draws the smaller and finer particulates from the main hopper 44 into the dust box 69 through opening(s) (not shown) in the wall 66. The opening(s) may be a baffle system or a device to create a tortuous air flow pattern. The curvature and air flow velocity causes the particulate matter to fall to the bottom of dust box 69 while the suction creates the air flow through filter 76 and out through the bulkhead 68.

When it is desired to empty the hopper 22, the hopper door 32 is closed. The suction device 78 is temporarily stopped and the hopper 22 begins to pivot about the pivot point 28. As the hopper door 32 closes the hopper opening 34, the resilient flap 56 flexes to allow the above-noted communication of the slot(s) 64 with the outlet opening 61. Since the dust and debris settles in this area, gravity causes the dust and debris to exit therefrom and fall into the main hopper 44. This position is depicted in FIG. 9.

When the hopper 22 is in its fully pivoted position as depicted in FIG. 10, most of the dirt and debris within the dust box 69 has emptied into the main hopper 44 mixing with the debris previously accumulated within hopper 44. The hopper door 32 is opened whereby gravity allows the emptying of the contents as shown in FIG. 2. The resilient flap 61 is again positioned to close opening 61 when the hopper door 32 is closed.

Figure 11:
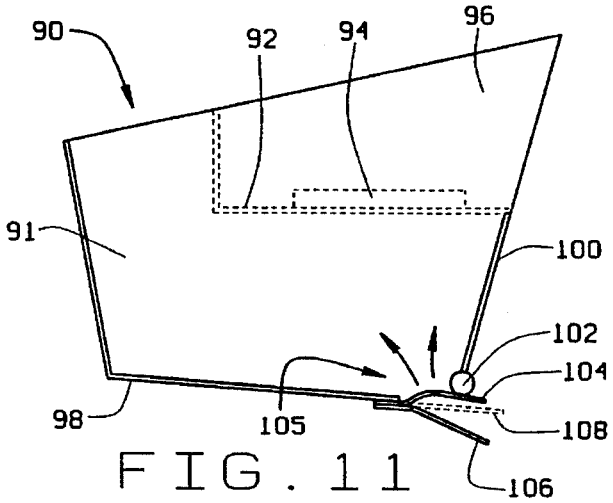
FIG. 11 is an enlarged side view of a dust box showing an alternative embodiment of a dust box dumping device.

Referring now to FIG. 11, there is shown an alternative embodiment of the present invention in which the resilient flap is not attached to or controlled by the movement of a hopper door.

In FIG. 11, only the dust box designated 90 is depicted. An interior chamber 91 is formed. A clean side 96 is defined by wall 92 with a filter 94 disposed therebetween. An outlet opening 105 is formed between a bottom wall 98 and an end wall 100. In accordance with this embodiment, a resilient flap 104 is attached to bottom wall 98, but is free to move at a point 102 on end wall 100. A thin metallic plate 106 is disposed beneath and adjacent the flap 104.

During the dust and debris collection state, suction as provided by the suction device 78 and described hereinabove, causes the flap 104 to be pulled upwardly along with the metal plate 106 as shown in the phantom line 108. The upward pulling causes the flap 104 which may or may not be slotted to form a seal over opening 105. The plate 106 is also upwardly pulled to provide a tight seal of the flap 56 against the wall 100.

When the hopper is in the dumping stage, and the suction from the suction device 78 is temporarily ceased, the resilient flap 104 and plate 106 are not upwardly biased thus opening the dust box outlet opening 105. This allows the dust accumulated within chamber 91 of the dust box 90 to be emptied.

Return of the dust box 90 to its accumulation state also starts the suction, whereby the flap 104 is upwardly drawn to close the outlet opening 105.

While the foregoing is directed to the preferred embodiment of the present invention, other and further embodiments of the invention may be devised without departing from the basic scope thereof, and the scope thereof is determined by the claims which follow.

What is claimed is:

1. In a sweeper having a hopper separated into a main hopper and a dust box, a filter disposed within the dust box and dividing the dust box into a clean side and a dirty side, the hopper having an inlet for influx of debris, the dust box having an inlet for influx of debris, the hopper being movable between a debris accumulation position and a debris discharge position, and an outlet in a wall of the dust box for removal of debris accumulated within the dust box, the sweeper characterized by:

a flap of resilient material disposed over the dust box outlet and operable to close the dust box outlet when the hopper is in the debris accumulation position, and to open the dust box outlet in the debris discharge position, said flap having at least one opening therein through which debris is adapted to be discharged when the hopper is in its said debris discharge position.

2. The sweeper of claim 1, wherein said at least one opening is rectangular in shape.

3. The sweeper of claim 1, wherein said resilient flap comprises:

a single elastomer sheet having a plurality of spaced-apart fingers on an end thereof, said fingers defining a plurality of openings therebetween.

4. In a sweeper having a hopper separated into a main hopper and a dust box, a filter disposed within the dust box and dividing the dust box into a clean side and a dirty side, the hopper having an inlet for influx of debris, the dust box having an inlet for influx of the debris, a suction system for drawing the debris into and through the hopper, the dust box and the filter, a hopper door adjacent the hopper inlet, the hopper door movable between an open position and a closed position relative to the hopper inlet, and an outlet in a wall of the dust box for removal of the debris accumulated within the dust box, the sweeper characterized by:

a flap of resilient material disposed over the dust box outlet and having an opening therein, said opening providing communication between the dust box and the main hopper when the hopper door is in the closed position wherein the accumulated debris within the dust box may fall into the main hopper for dumping, said opening closed from communication when the hopper door is in the open position.

5. The sweeper of claim 4, wherein said flap is attached at one end to the dust box wall and attached at another end to the hopper door.

6. The device of claim 5, wherein said resilient material is an elastomer.

7. The sweeper of claim 4, wherein said resilient flap comprises:

a single elastomer sheet having a plurality of spaced-apart fingers on an end thereof, said fingers defining openings therebetween.

8. The sweeper of claim 7, wherein said fingers are attached to the hopper door and another end of said flap is attached to the dust box wall.

9. A device for the selective retention and removal of dust and debris from a dust box defined within a sweeper hopper by upper and lower walls, the hopper having an inlet for the inflow of dust and debris and a hopper door disposed adjacent the hopper inlet, the dust box having an inlet for the inflow of dust and debris and an opening in the lower wall for the egress of the dust and debris, the device comprising:

a sheet of a resilient material disposed over the dust box opening, said sheet attached at one end to the lower wall of the dust box and attached at another end to the hopper door, said sheet having a plurality of bands defining a plurality of slots at said another end, said slots permitting communication between the dust box and the hopper only when said hopper door is in a closed position.

10. An industrial sweeper comprising:

a frame;

a hopper carried by said frame, said hopper having a debris inlet at a lower end thereof;

a hopper door pivotably coupled at said hopper debris inlet, said hopper door movable between an open position and a closed position;

a rotatable brush adjacent said hopper inlet;

a dust box formed within said hopper, said dust box having a debris inlet, an air outlet with a filter disposed thereover, and a debris outlet;

a suction system in communication with said dust box and said hopper through said filter; and a flap disposed over said debris outlet and attached at one end to a lower wall forming said dust box and attached at another end to said hopper door, said flap having a plurality of slots therein that allow communication between said dust box and said hopper when said hopper door is in the closed position to effectuate a dumping of the accumulated dust and debris of said dust box, and which are obstructed from communication between said dust box and said hopper when said hopper door is in the open position thereby allowing accumulation of dust and debris within said dust box during the sweeping operation.

11. The sweeper of claim 10, wherein said flap is formed of a single sheet of elastomeric.

12. The sweeper of claim 10, wherein said plurality of slots are each rectangular in shape.

13. In a sweeper having a hopper separated into a main hopper and a dust box, a filter disposed within the dust box and dividing the dust box into a clean side and a dirty side, the hopper having an inlet for influx of debris, the dust box having an inlet for influx of the debris, a suction system for drawing the debris into and through the hopper, the dust box and the filter, the hopper being movable between a debris collection position and a debris discharging position, and an outlet in a wall of the dust box for removal of the debris accumulated within the dust box, said outlet facing downwardly when the hopper is in a debris collection position, the sweeper characterized by:

a flap of resilient material disposed over the dust box outlet, said flap being movable to a generally horizontal position to close the downwardly facing dust box outlet when the suction system is operative and the hopper is in the debris collection position, and said flap being operable to drop down to open the dust box outlet when the suction system is non-operative and the hopper is in the debris discharge position.

14. The sweeper of claim 13, wherein said flap is attached at one end to the dust box wall.

15. The sweeper of claim 13, further characterized by:

a plate disposed beneath and adjacent said flap, said plate being responsive to the suction system to move with said flap.

* * * * *